US005584733A

United States Patent [19]

Kobayashi

[11] Patent Number: 5,584,733

[45] Date of Patent: Dec. 17, 1996

[54] PERSONAL JET PROPELLED WATERCRAFT

[75] Inventor: Noboru Kobayashi, Iwata, Japan

[73] Assignee: Yamaha Hatsudoki Kabushiki Kaisha, Iwata, Japan

[21] Appl. No.: 398,162

[22] Filed: Mar. 2, 1995

Related U.S. Application Data

[62] Division of Ser. No. 54,401, Apr. 28, 1993, Pat. No. 5,438, 946.

[30] Foreign Application Priority Data

Mar. 23, 1993 [JP] Japan ..... 5-64277

[51] Int. Cl.[6] ..... B63H 11/08

[52] U.S. Cl. ..... 440/38; 440/89; 440/111

[58] Field of Search ..... 440/111, 38, 40–43, 440/89

[56] References Cited

U.S. PATENT DOCUMENTS

| | | | |
|---|---|---|---|
| 3,044,260 | 7/1962 | Hamilton | 440/43 |
| 3,601,989 | 8/1971 | Austin | 440/41 |
| 3,948,206 | 4/1976 | Tyler | 114/270 |
| 3,982,497 | 9/1976 | Caron | 114/270 |
| 4,026,235 | 5/1977 | Woodfill | 440/42 |
| 4,457,724 | 7/1984 | Miyamoto | 440/89 |
| 4,583,996 | 9/1985 | Inwood | 440/38 |
| 4,768,983 | 9/1988 | Smith | 114/270 |
| 4,907,673 | 2/1990 | Ginter et al. | 114/362 |
| 4,951,465 | 8/1990 | Torigai | 440/89 |
| 4,998,966 | 2/1991 | Yamaguchi | 114/270 |
| 5,076,190 | 12/1991 | Iikawa | 114/270 |
| 5,097,789 | 3/1992 | Oka | 114/270 |
| 5,237,950 | 8/1993 | Abe et al. | 114/270 |
| 5,460,552 | 10/1995 | Blanchard et al. | 440/38 |
| 5,460,553 | 10/1995 | Craig et al. | 440/38 |
| 5,490,804 | 2/1996 | Blanchard et al. | 440/38 |

FOREIGN PATENT DOCUMENTS

| | | | |
|---|---|---|---|
| 1321564 | 12/1963 | France | 440/38 |
| 57-110593 | 7/1982 | Japan . | |
| 61-36088 | 2/1986 | Japan . | |
| 61-188294 | 8/1986 | Japan . | |
| 2310191 | 12/1990 | Japan | 114/363 |
| 3193587 | 8/1991 | Japan | 114/270 |

*Primary Examiner*—Sherman Basinger
*Attorney, Agent, or Firm*—Knobbe, Martens, Olson & Bear

[57] ABSTRACT

Several embodiments of personal watercraft being adapted to accommodate at least two riders seated in straddle, tandem fashion. The watercraft are powered by a combined jet propulsion unit and powering internal combustion engine which is positioned vertically above the jet propulsion unit and which is positioned at the extreme rear of the hull beneath a rear seat portion. The hull is wider at the rear than the front so as to provide added buoyancy and the center of gravity is disposed to the rear of the hull to improve turnability. This affords a large area for locating engine accessories and storage compartments as well as buoyant masses for the hull.

7 Claims, 12 Drawing Sheets

PERSONAL JET PROPELLED WATERCRAFT

This application is a divisional of application Ser. No. 08/054,401, filed Apr. 28, 1993, and now U.S. Pat. No. 5,438,946.

BACKGROUND OF THE INVENTION

This invention relates to a personal jet propelled watercraft and more particularly to an improved drive and seating arrangement for such a watercraft.

Jet propelled watercraft have a number of advantages over more conventional propeller propelled watercraft that make them highly desirable for a wide variety of applications. In addition to being capable of operating in shallower water than a conventional propeller driven watercraft, jet propelled watercraft generally can provide a more pleasing appearance since the entire engine and propulsion unit can be concealed within the hull.

A particularly popular type of jet propelled watercraft is designed to be operated by one or more riders seated in tandem, straddle fashion. With this type of watercraft, however, it has been generally the practice to provide a tunnel beneath the seat in which the powering jet propulsion unit is positioned. The engine is then positioned forwardly of the tunnel at either a mid or bow location and drives the jet propulsion unit through a shaft that extends through a bulkhead separating the tunnel from the forwardly positioned engine compartment. Although this arrangement has a number of advantages, it also presents some disadvantages.

For example, in the type of drive layout previously noted, the vehicle is provided with very little storage capability. As a result of this, the use of the vehicles having this type of drive is relatively limited. For the most part, these type of watercraft are limited to recreational activities and cannot be utilized for utilitarian purposes.

It is, therefore, a principal object to this invention to provide an improved hull, seating and propulsion arrangement for a jet propelled watercraft.

It is a further object to this invention to provide an improved hull, seating and drive arrangement for a small jet propelled watercraft wherein the watercraft can provide a large storage capacity.

It is a further object to this invention to provide an improved hull and drive arrangement for a jet propelled watercraft wherein the engine and drive may be positioned at therear of the watercraft.

In many instances it is desirable to provide a larger concentration of the weight of the watercraft at the rear of the watercraft. Such rear positioning of the center of gravity improves the ability to make turns in the watercraft. However, for the reasons discussed above, prior watercraft having jet propulsion units have not permitted such a large rearward weight bias.

It is, therefore, a still further object to this invention to provide an improved hull, drive and seating arrangement for a jet propelled watercraft that permits the center of gravity to be positioned more closely adjacent the rear of the watercraft.

Where the engine and drive for the watercraft is positioned at the rear of the watercraft, there arise some problems. That is, if the watercraft has a rearwardly biased center of gravity, then it is also necessary to provide additional floatation at the rear of the watercraft.

It is, therefore, a still further object to this invention to provide an improved hull, engine compartment and seating arrangement for a jet propelled watercraft wherein the hull accommodates a large portion of the center of gravity of the watercraft at its rear portion.

In addition to the floatation situation, when the engine and drive for the watercraft is positioned at the rear of the watercraft, it is important to insure that the engine is well protected from the body of water in which the watercraft is operating and also that the riders of the watercraft are protected from water splashing up at the rear.

It is, therefore, a still further object to this invention to provide an improved hull configuration for a watercraft powered by a jet propulsion unit and engine mounted at the rear of the watercraft.

It is a further object to this invention to provide an improved arrangement for protecting the engine and the occupants from water and also permitting water to drain easily so that it will not accumulate in either the passenger or engine areas.

There have been proposed small jet propelled watercrafts wherein the jet propulsion unit is positioned-directly beneath the powering internal combustion engine. This type of drive layout has a number of advantages in offering compactness and maximum space utilization. However, this type of drive arrangement has only been used in the type of small watercraft that is operated by a single rider sitting on top of the area where the engine and power unit are contained.

It is, therefore, a still further object to this invention to provide an improved jet propelled watercraft of the type embodying an engine positioned above the jet propulsion unit which it drives and which accommodates more than a single rider.

SUMMARY OF THE INVENTION

This invention is adapted to be embodied in a jet propelled watercraft comprised of a hull defining a rider's area at the rear end thereof and which includes a seat that is adapted to accommodate at least a pair of riders seated in straddle, tandem fashion. The seat terminates contiguous to the transom of the hull and an internal combustion engine and jet propulsion unit are positioned beneath the rear portion of the seat and forwardly of the transom for propelling the hull.

DETAILED DESCRIPTION OF THE PREFERRED EMBODIMENTS OF THE INVENTION

Figure 1:
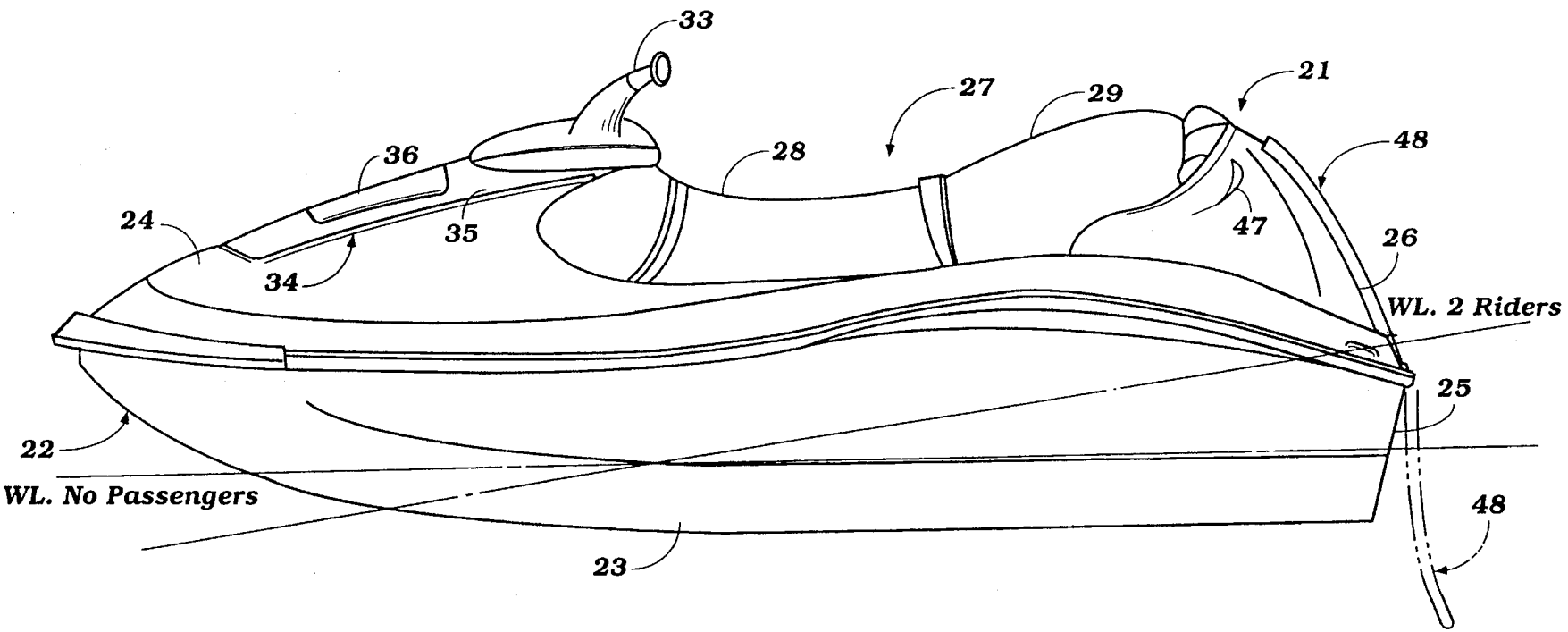
FIG. 1 is a side elevational view of a personal jet propelled watercraft constructed in accordance with a first embodiment of the invention, showing the boarding ladder in its running condition in solid lines and in its boarding condition in phantom lines.

Referring now in detail to the drawings-and first to the embodiment of FIG. 1, a personal watercraft constructed in accordance with this embodiment is identified generally by the reference numeral 21. The watercraft 21 is comprised of a hull, indicated generally by the reference numeral 22 and comprised primarily of lower hull portion 23 and an upper deck portion 24. The hull and deck portions 23 and 24 may be formed from any suitable material such as a molded fiberglass reinforced resinous plastic or the like. The hull and deck portions 23 and 24 are secured together around their periphery in any suitable manner.

The hull portion 23 has a transom part 25 and, for a reason to be described, the deck portion 24 also has a transom part 26 that is adapted to be form an extension of the transom part 25 of the hull portion 23 and which defines the rear boundary of a passenger's area, indicated generally by the reference numeral 27. The passenger's area 27 includes a seat that is comprised of a front cushion portion 28 and a rear cushion portion 29, which portions may be formed separately from each other with both of the portions 28 and 29 being readily removable for a reason which will become apparent. The deck portion 24 forms a pair of foot areas 31 and 32 on opposite sides of the seat portions 28 and 29 as most clearly shown in FIG. 2 and these foot areas 31 and 32 are closed at thier rear ends by a upstanding wall which merges into the deck transom part.26. The seat portions 28 and 29 are sized so as to accommodate one, two or possibly three riders seated in straddle, tandem fashion.

Figure 2:
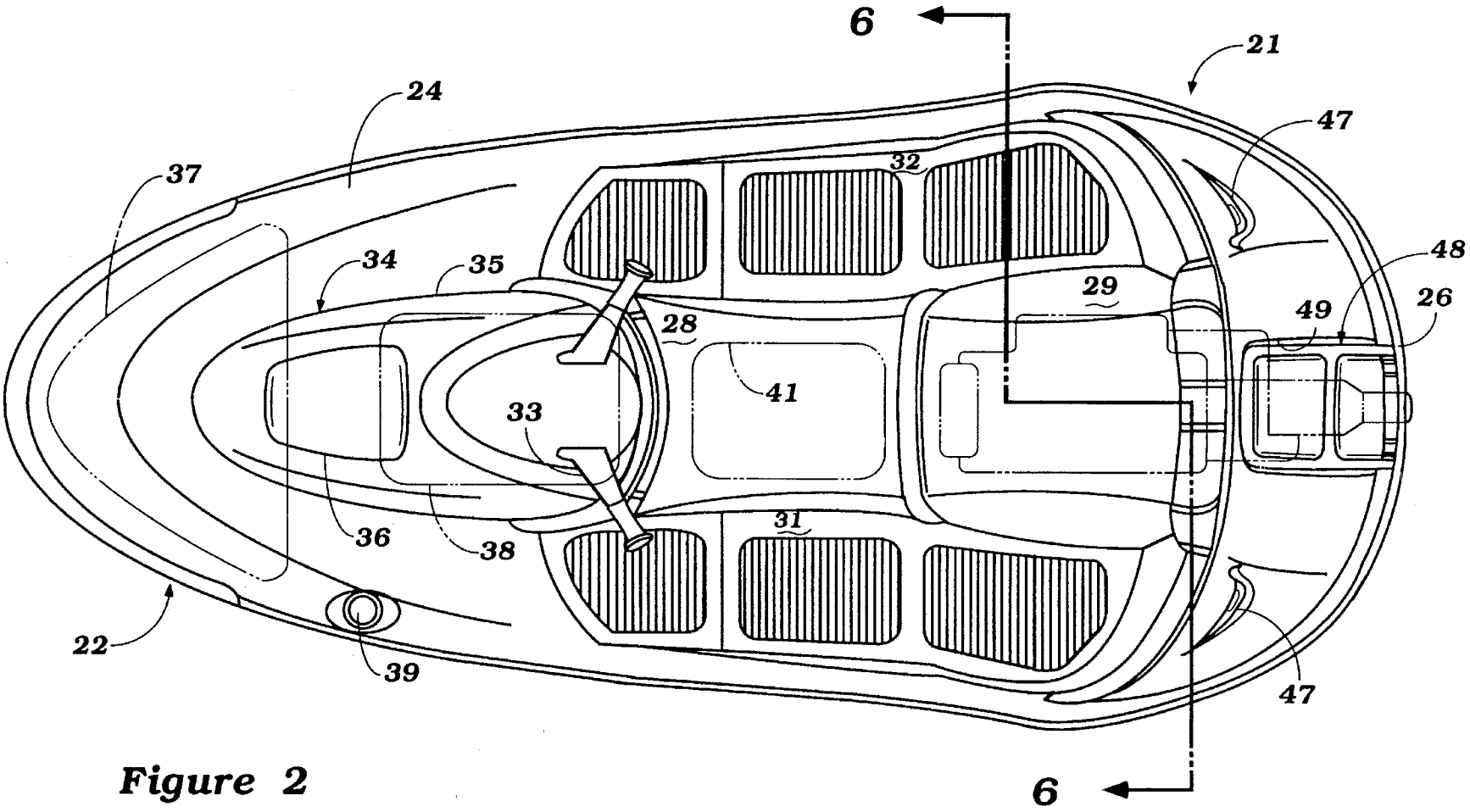
FIG. 2 is a top plan view of the watercraft.

As may be seen in the top view of FIG. 2, the configuration of the hull 22 is such that the hull begins at a fairly narrow bow and gradually tapers outwardly so as to increase its width until the area of the seat 29. From the area of the seat 29 rearwardly, the width of the hull 22 is substantially increased and then rounded out at the transom parts 25 and 26 of the hull and deck portions 23 and 24. As a result of this configuration, there is substantially more buoyancy at the rear of the hull 22 than at the front of the hull 22. The reason for this will become apparent as the description proceeds and it should also be noted that the seating area is disposed at the rear of the hull and at least in substantial part in this more buoyant area.

Controls for operating the watercraft 21 are disposed forwardly of the seat portions 28 and 29 and specifically immediately forwardly of the seat portion 28. These controls include a handle bar assembly 33 which controls the steering of the watercraft 21 and may additionally contain throttle control for the powering internal combustion engine, to be described, and a reverse thrust bucket control if desired.

A removable hatch assembly, indicated generally by the reference numeral 34 and comprised of a first lift off position 35 and a smaller portion 36 36 pivotal to the portion 35 is positioned on the deck 24 and covers an opening formed therein. Suitable latching means may be provided for holding the hatch assembly 34 in its closed position as shown in the drawings. The small hatch portion 36 may be pivoted between its closed position and an open position as shown in phantom in FIG. 3.

The configuration of the hull 22 provides a generally open area throughout the entire length of the watercraft 21 which affords large areas to locate the various components for the watercraft. These components are shown in part in phantom in FIGS. 2 and 3 and are comprised of a floatation device 37 which is positioned in the bow of the watercraft and which may be formed from a material such as a formed plastic. The floatation 37 provides buoyancy at the front of the watercraft 21.

Immediately behind the floatation device 37 and beneath the handle bar assembly 33 is a fuel tank 38. The fuel tank 38 has a fill neck 39. In addition, the entire hatch cover 34 may be removed so as to permit installation and removal of the fuel tank 38.

An internal bulkhead 39 of the hull 22 separates the forward storage area containing the fuel tank 38 and floatation device 37 from the area beneath the front seat portion 28. A storage compartment 41 is positioned beneath the front seat portion 28 and can be readily accessed through removal of this seat portion, as aforenoted.

A further bulkhead 42 is provided in the interior of the hull and closes the compartment containing the storage compartment 41 from a rear portion where the power unit for propelling the watercraft is positioned. This power unit is indicated generally by the reference numeral 43 and has a construction as will be described later by reference to FIG. 11. Basically, the power plant 11 includes an internal combustion engine 44 which is mounted above and which drives a jet propulsion unit 45 in a manner which will be described. This vertical orientation of the power unit 43 centers a large mass of the watercraft 21 to the rear of the hull 22 and thus provides a rearward bias for the center of gravity of the watercraft 21. This permits sharper more sensitive steering for the watercraft 21. As has been previously noted, the size of the hull 22 is such that this heavier portion of the hull will be well balanced by the added buoyancy so as to provide a relatively even ride height. FIG. 1 shows how the watercraft 21 rides in the water with no passenger and also with two adult passengers.

Certain additional auxiliaries for the power unit 43 may be contained within the hull to the rear of the bulkhead 42. For example, a battery or batteries 46 may be mounted immediately to the rear of the bulkhead 42 and forwardly of the power unit 43. This again improves the rearward weight bias of the watercraft 21. The engine compartment is readily accessible by removal of the seat portion 29 as aforenoted.

To provide air for the operation of the engine 44 and ventilation of the engine compartment, there are provided a pair of vent openings 47 in the upper rear part of the deck portion 24 immediately to the rear of the passengers area 27. These vent openings 47 are configured so as to admit air but to preclude the likelihood that water can enter the engine compartment.

In addition, water drains (not shown) are provided at the foot areas 31 and 32 so as to permit water to drain from these foot areas. It should be noted that the relatively high transom part 26 of the deck portion 24 will sheltered the occupants of the watercraft from water which may otherwise attempt to enter on sudden declarations. Any water which does enter can be drained through the aforementioned drain passages so as to provide in effect a self-bailing operation for the watercraft.

In order to facilitate entry and exit of the watercraft 21 from the body of water in which it is operating, there is provided a boarding ladder, indicated generally by the reference numeral 48 and which is shown in most detail in FIGS. 1, 2, 4 and 5. This boarding ladder 48 is normally fitted into a complimentary recess 49 formed in the deck transom part 26 so as to provide a neat appearance when the boarding ladder 48 is not in use as shown in the solid line positions of FIGS. 1, 2 and 4. The boarding ladder 48 is pivotally supported on a pair of pivot pins 51 so that it can be swung down into the body of water for boarding or exit purposes as shown in the solid line view of FIG. 8 and the phantom line view of FIG. 1. Because of the relatively high transom 26 of the deck portion 24, this boarding ladder is particularly useful in this embodiment.

A personal watercraft constructed in accordance with another embodiment of the invention is illustrated in FIGS. 7 through 10 and is identified generally by the reference numeral 101. This watercraft 101 is substantially the same, in many respects, as the watercraft 21 of the embodiments of FIGS. 1 through 6 and where the components are the same or substantially the same, they have been identified by the same reference numerals and will be described again only insofar as is necessary to understand the construction and operation of this embodiment.

Figure 8:
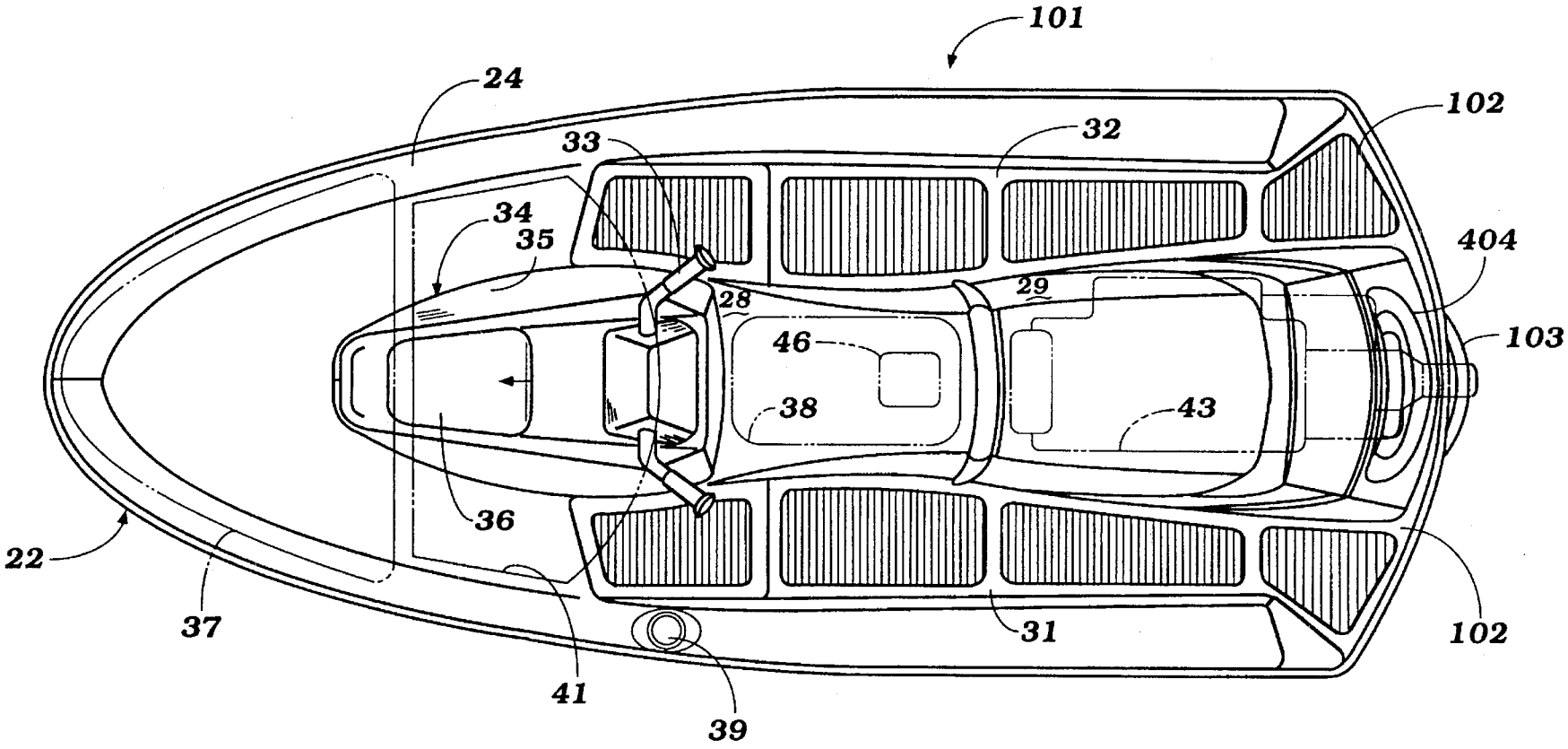
FIG. 8 is a top plan view of this embodiment.

The basic differences between the two embodiments is the relocation of the battery, storage area and fuel tank in this embodiment and the fact that the transom of the deck portion 24 is opened so that the foot areas 31 and 32 open through the rear of the transom as best seen in FIG. 8.

Figure 9:
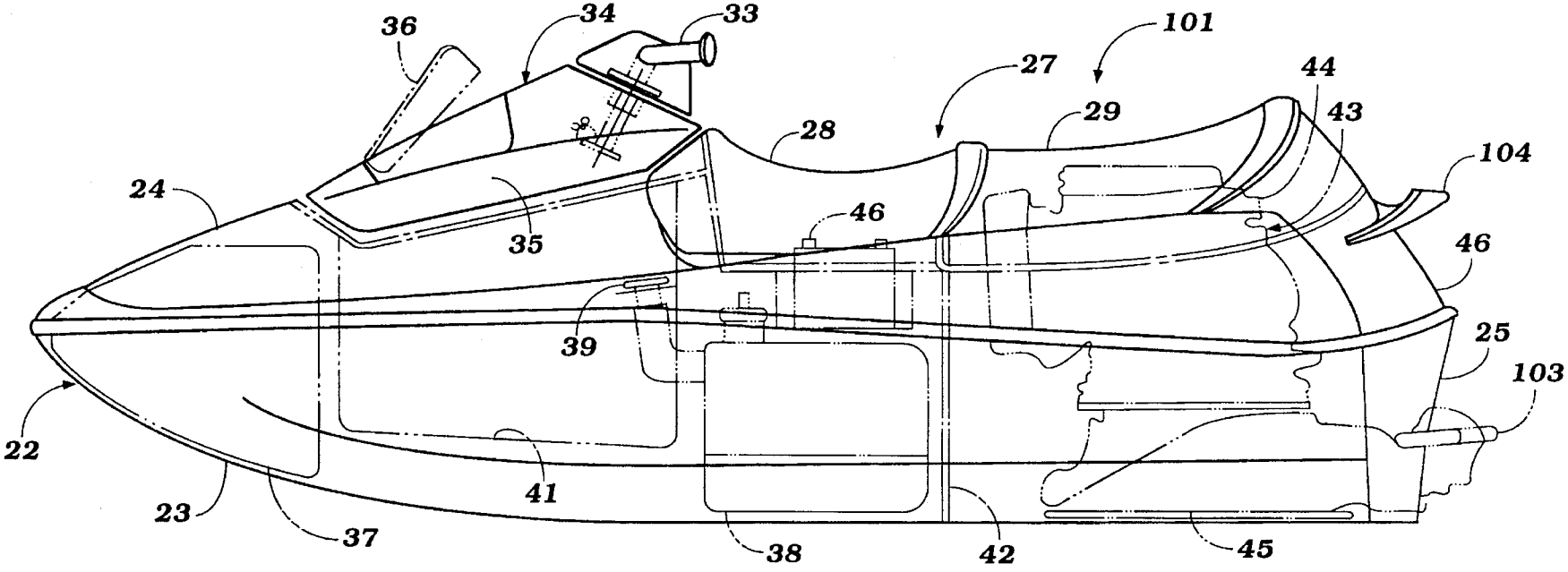
FIG. 9 is a side elevational view, in part similar to FIG. 7, and shows the layout of certain of the major components and the hatch cover portion in its open position in phantom lines.
Figure 10:
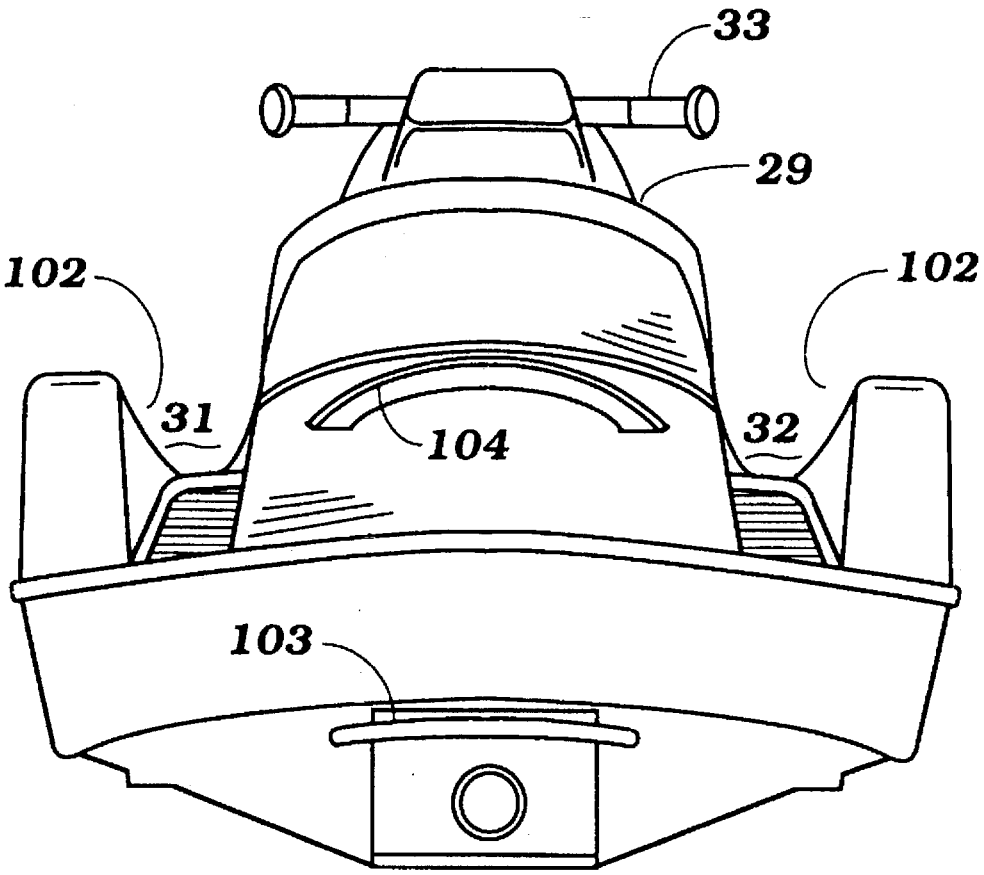
FIG. 10 is a rear elevational view of this embodiment.

As may be seen in FIGS. 8 and 9, the buoyancy device 37 of the previously described embodiment is still positioned in the bow of the hull 22 forwardly of the hatch cover 34. In this embodiment, however, a large storage compartment, again indicated by the reference numeral 41, is positioned beneath the removable hatch cover 34 and can be accessed through opening of the smaller pivoted hatch portion 36. In addition, larger articles may be placed in the storage compartment 41 by removal of the complete hatch cover 34.

The fuel tank 38 is positioned beneath the seat portion 28 in this embodiment and can be installed and removed through removal of the seat portion 28. However, the fill neck 39 still extends forwardly on the bulwark and can be accessed by a passenger standing on the foot areas 31 and 32 for filling. This rearward positioning of the fuel tank 38 still further improves the rearward weight bias of the watercraft 101.

The battery 46 in this embodiment is also positioned beneath the seat portion 28 and forwardly of the bulkhead 42. The battery 46 can be easily accessed for servicing through removal of the seat portion 28.

The power unit 43 is rearwardly mounted as with the previously described embodiment and includes the engine 44 that is positioned vertically above the jet propulsion unit 45.

As has been noted, the foot areas 31 and 32 are opened through the transom of the watercraft in this embodiment and these open areas may be best seen in Fibres 8 and 10 where they are identified by the reference numerals 102. These open areas permit the riders to board the watercraft through the rear from the body of water in which the watercraft 101 is operating more easily. Of course, less water protection is provided for the occupants but any water entering the foot areas 31 and 32 through the open transform areas 102 may be readily drained out of this area.

To afford ease of entry, a foot rail 103 is mounted on the hull transom portion 25 and also in a position to provide some protection for the jet propulsion unit discharge nozzle, as will be described. A further grab handle 104 may be formed on the transom part 46 of the rear deck portion 24 and this handle 104 will also provide some splash protection for the occupants.

Figure 12:
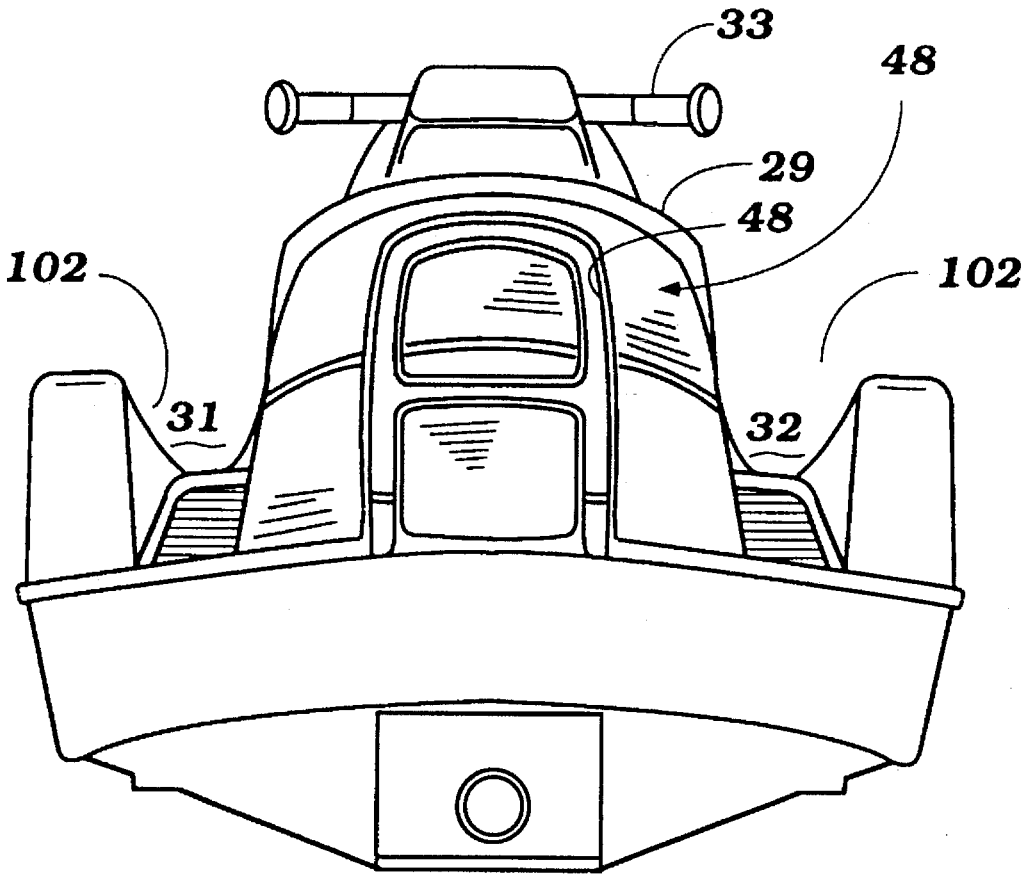
FIG. 12 is a rear elevational view, in part similar to FIG. 10, and shows another embodiment of the invention.

If desired, a folding boarding ladder of the type employed in the embodiment of FIGS. 1–6 may be substituted for the grab handle 104 and foot rail 103 and such an embodiment is shown in FIG. 12.

Figure 11:
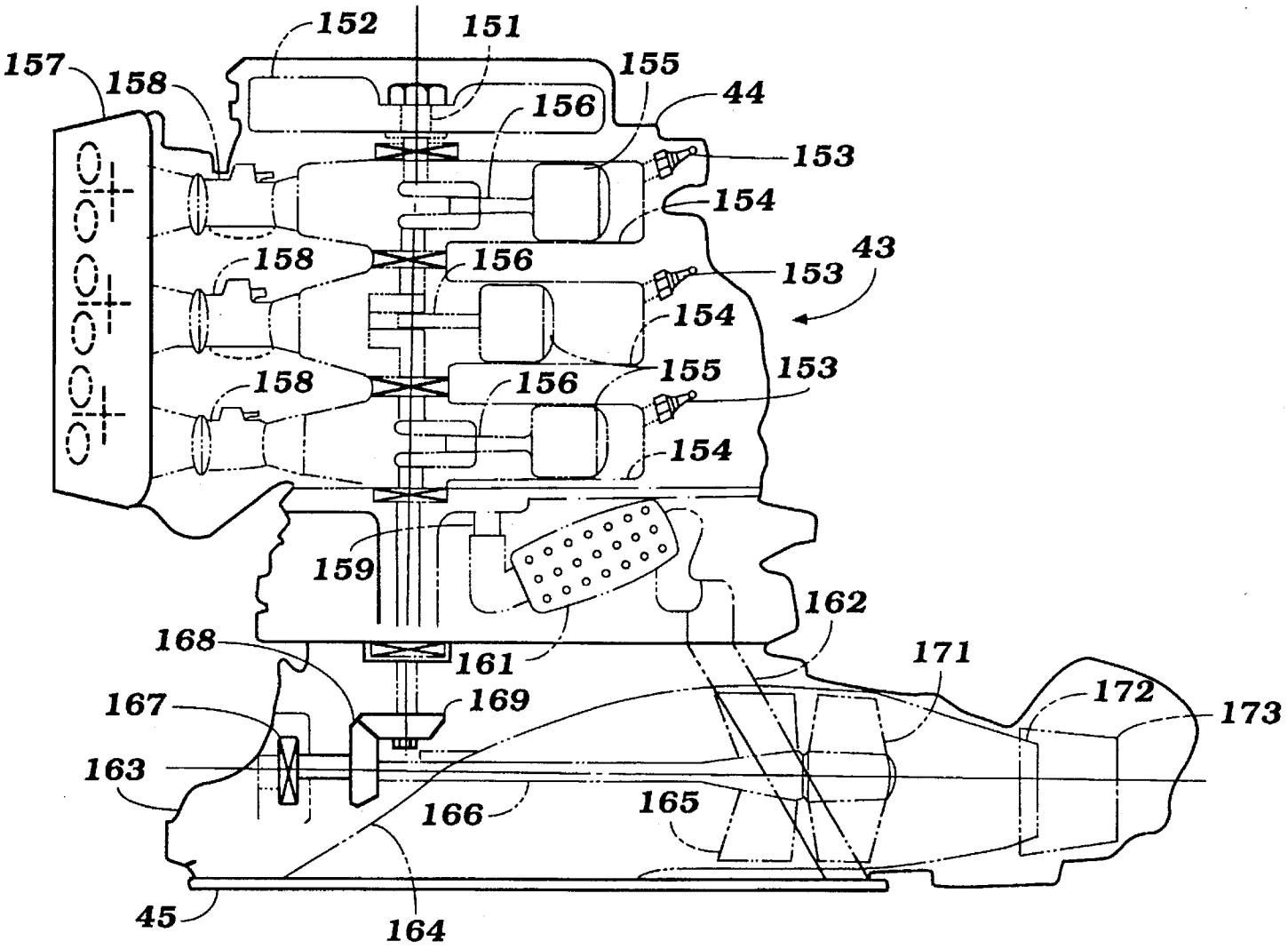
FIG. 11 is a side elevational view, with portions shown in phantom, showing the engine drive arrangement for each embodiment.

The power unit 43 which may be employed with either of the watercrafts 21 or 101 is shown in more detail in FIG. 11 and will now be described by particular reference to that figure. As has been previously noted, the power unit 43 includes an internal combustion engine 44 mounted over and driving a jet propulsion unit 45. In the illustrated embodiment, the engine 44 is of the V-6 type operating on a two stroke crankcase. compression principal. This type of power unit is just typical of those which may be employed in conjunction with the invention. Although other cylinder numbers and types are possible, it is particularly advantageous to dispose the engine 44 so that its crankshaft or output shaft 151 rotates about a vertically extending axis. A flywheel magneto 152 is affixed to the upper end of the crankshaft 151 and provides electrical power and also forms a portion of the ignition circuit for firing spark plugs 153 of the engine.

In the figure, only one cylinder bank is shown as the other cylinder bank lies behind the illustrated one. This cylinder bank includes cylinder bores 154 formed by a cylinder block and in which pistons 155 reciprocate. The pistons 155 are connected by means of connecting rods 156 to the crankshaft 151 for driving it in a known manner. The spark plugs 153 are mounted in cylinder heads affixed to the cylinder banks.

A fuel/air charge is delivered to the individual sealed crankcase chambers of the engine 44 by an induction system that includes an air inlet and silencing device 157 which extends forwardly from the crankcase of the engine. The air inlet device 157 supplies the silenced air charge to a plurality of carburetors 158 which, in turn, deliver a fuel/air mixture to the crankcase chambers through an induction system and reed type check valves.

The internal construction of the engine 44 is not illustrated and will not be described in anymore detail as it is believed that those skilled in the art will readily understand how the invention can be practiced with any known types of engines.

The engine has an exhaust system which includes one or more exhaust pipes 159 that extend downwardly into an expansion chamber formed at the lower end of the engine 44 and in which a perforated silencing device 161 is positioned. The silenced exhaust gases are then discharged downwardly through an exhaust discharge pipe 162 that discharges downwardly through an outlet opening formed in the lower portion of the power unit 43 for silencing by discharge of the exhaust gases beneath the water in which the watercraft is operating.

Figure 3:
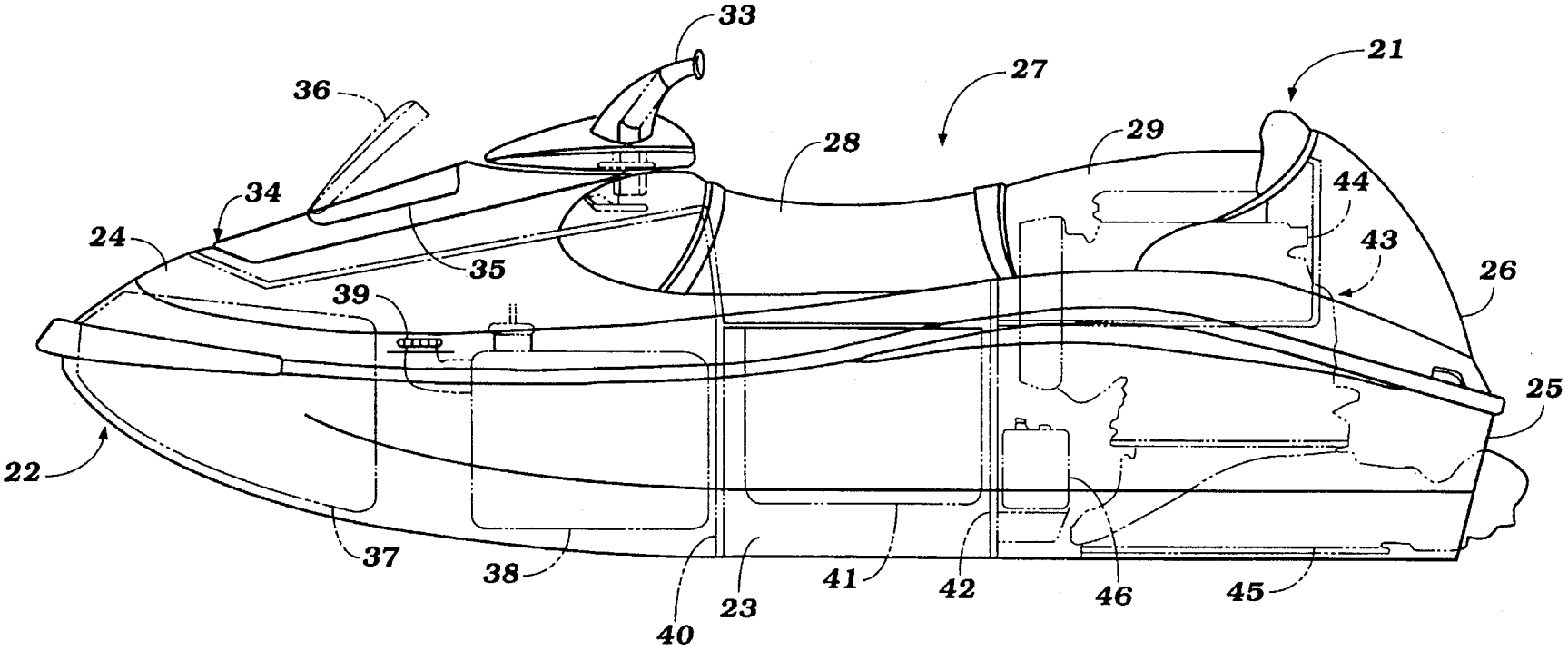
FIG. 3 is a side elevational view in part similar to FIG. 1, but showing the location of certain of the major components in phantom and also showing how the hatch cover portions may be opened.
Figure 4:
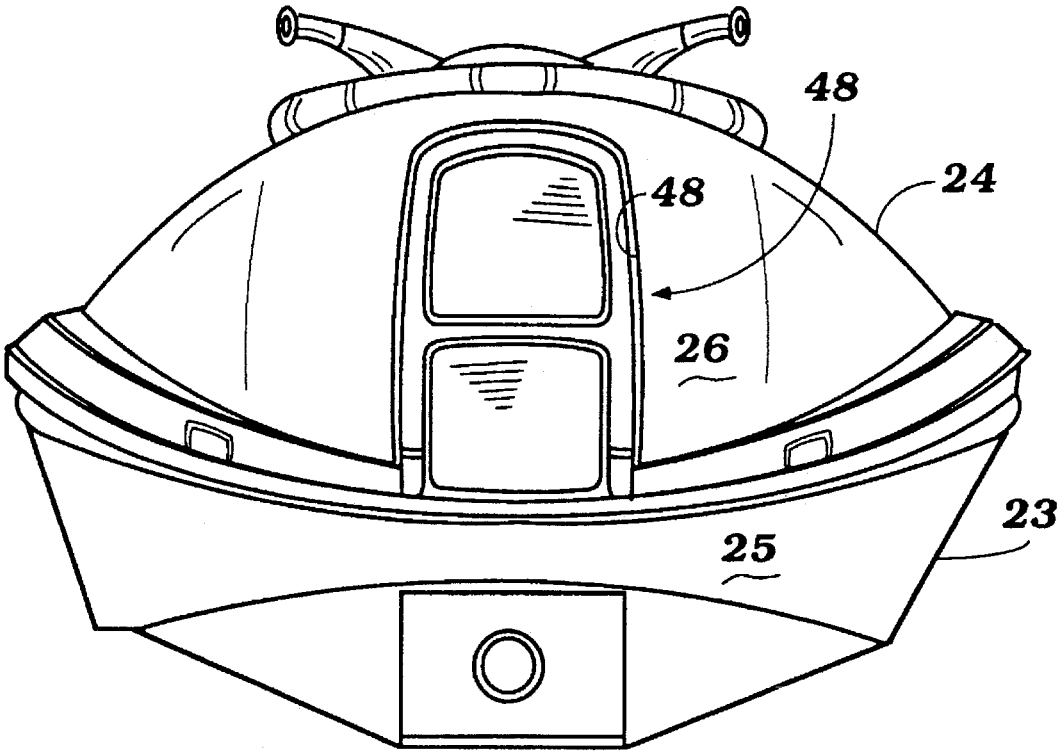
FIG. 4 is a rear elevational view of the watercraft showing the boarding ladder in its normal running condition.
Figure 5:
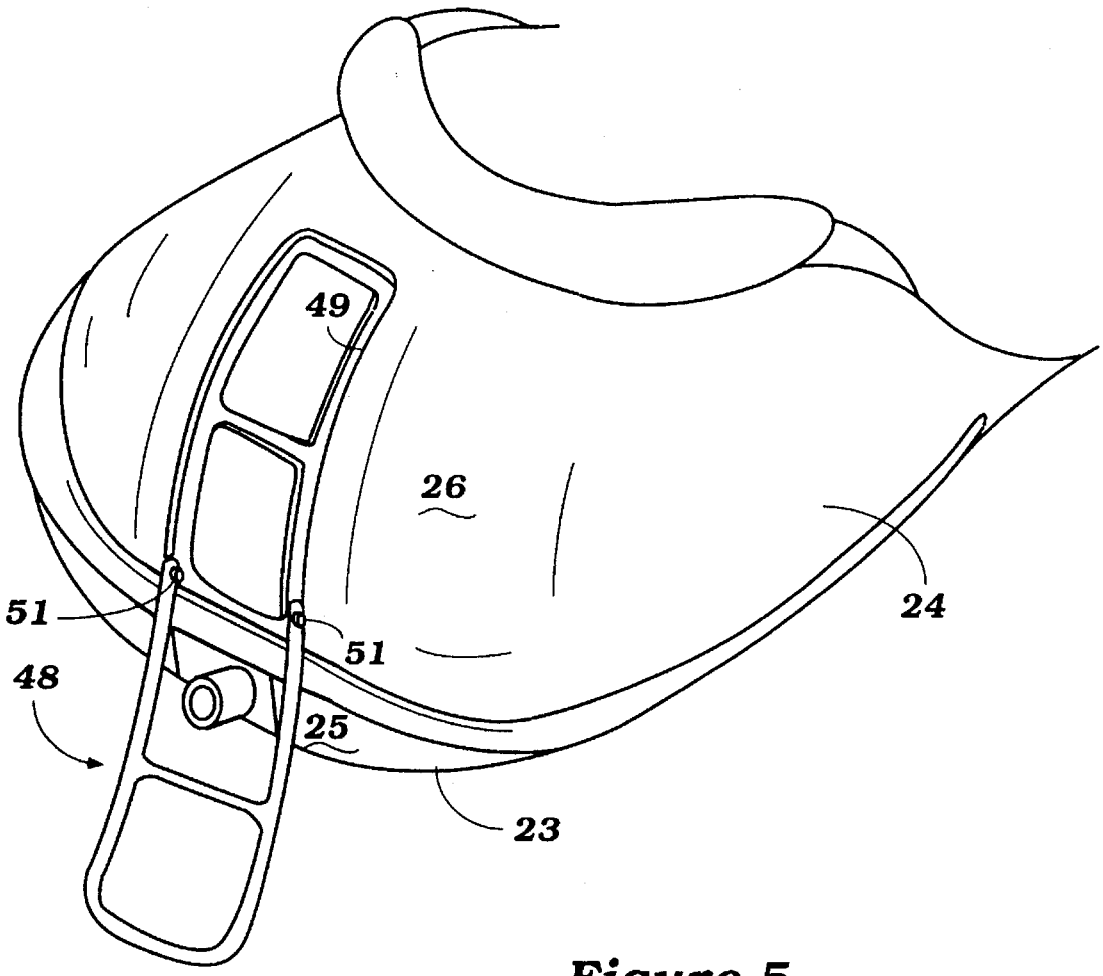
FIG. 5 is a rear portion of the watercraft showing the boarding ladder in its boarding position.
Figure 6:
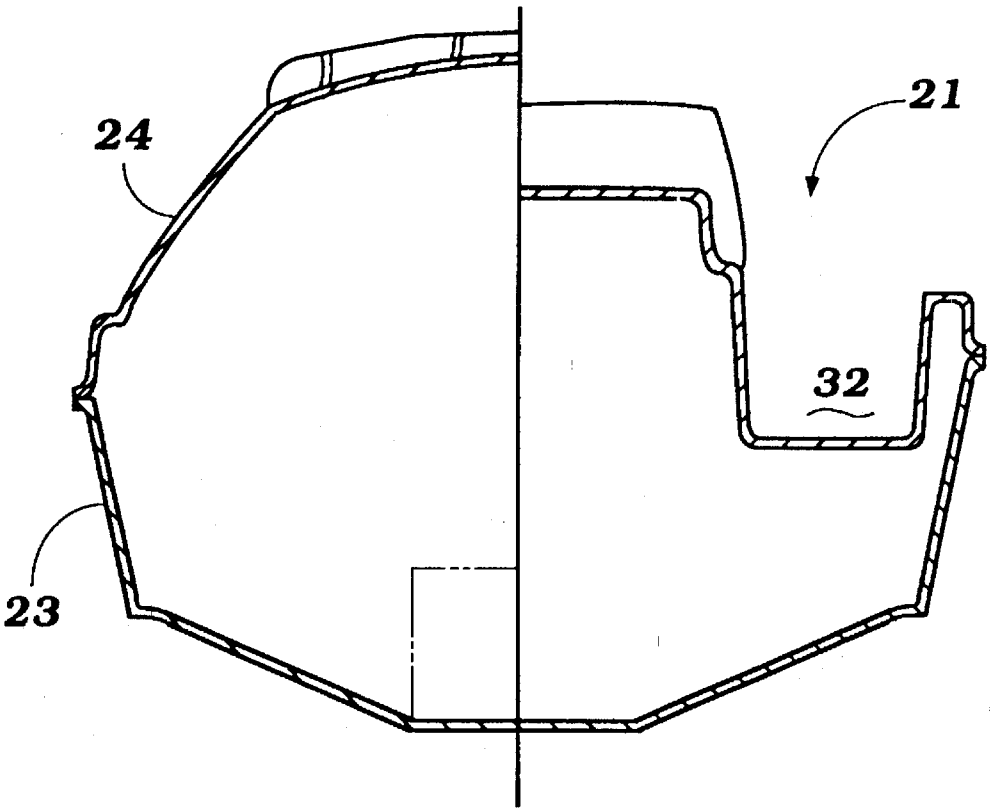
FIG. 6 is a cross sectional view of the hull configuration taken along the line 6—6 of FIG. 2.
Figure 7:
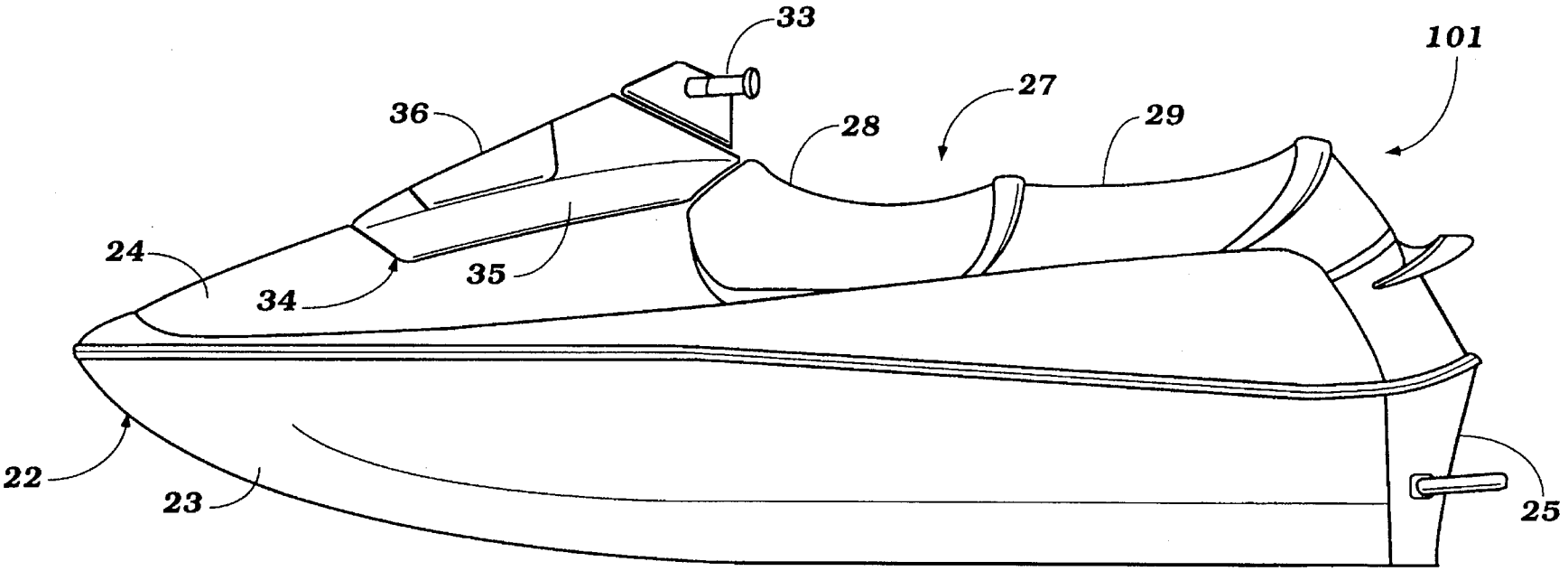
FIG. 7 is a side elevational view, in part similar to FIGS. 1 and 3, showing another embodiment of the invention.

The jet propulsion unit 45 includes an outer housing 163 that forms a downwardly opening, water inlet opening 164 formed in its lower surface and which is configured and arranged so as to be in substantial alignment with the undersurface of the hull 22, as seen in FIGS. 3 and 9 and through which water may be drawn from the body of water in which the watercraft 101 is operating. An impeller 165 pumps this water and the impeller 165 is journalled rearwardly of the water inlet opening 164 in the housing 163. The impeller 165 is affixed to an impeller shaft 166 that is journalled in a forward bearing 167. A bevel gear 168 is affixed to the impeller shaft 166 and is driven by a bevel gear 169 affixed to the lower end of the crankshaft 151 for driving the impeller 165.

The water pumped by the impeller 165 is discharged rearwardly past a plurality of straightening vanes 171 through a discharge nozzle 172 and a pivotally supported steering nozzle 173 for steering of the watercraft. In addition, a reverse thrust bucket may be provided so as to permit reverse operation of the watercraft 21 or 101.

It should be readily apparent from the foregoing description that the described embodiments of the invention provide very effective personal watercraft that provide a rearward weight bias and large areas for storage and location of the various components. Of course, the foregoing description is that of preferred embodiments of the invention and various changes and modifications may be made without departing from the spirit and scope of the invention, as defined by the appended claims.

I claim:

1. A combined engine and jet propulsion unit and watercraft having a hull with an undersurface for submersion in a body of water, said engine and jet propulsion unit being configured for positioning as a unit within said watercraft hull for powering said watercraft, said unit comprising a jet propulsion outer housing having a downwardly facing water inlet portion formed in a lower surface of said outer housing in substantial alignment with said hull undersurface, an axial flow impeller portion supporting an impeller for rotation for drawing water through said water inlet portion and a discharge nozzle portion through which water pumped by said impeller is discharged for providing a propulsion force to the associated watercraft, an impeller shaft fixed to said impeller and journaled in said jet propulsion unit outer housing and extending at least in part through said water inlet portion, an internal combustion engine supported upon the upper end of said jet propulsion unit outer housing in proximity to its water inlet portion and having a vertically. extending output shaft, transmission means for coupling said engine output shaft to said impeller shaft forwardly of said impeller for driving said impeller and an exhaust silencing chamber contained entirely between the lower end of said engine and the upper end of said jet propulsion unit outer housing and containing an exhaust silencing device to which exhaust gases are delivered directly from said engine for silencing the exhaust gases and for discharging them to the atmosphere through an exhaust outlet formed by said combined engine and jet propulsion unit.

2. A combined engine and jet propulsion unit and watercraft as set forth in claim 1, wherein the engine has a plurality of cylinders driving the output shaft and extending in generally horizontal planes and rearwardly of the output shaft.

3. A combined engine and jet propulsion unit and watercraft as set forth in claim 2, wherein the cylinders are disposed in a V formation.

4. A combined engine and jet propulsion unit and watercraft as set forth in claim 3, wherein the engine operates on a 2-stroke crankcase compression principle and further including charge forming means formed at the front of the engine and forwardly of the output shaft for delivering a charge to crankcase chambers of the engine.

5. A combined engine and jet propulsion unit and watercraft as set forth in claim 1, wherein the engine operates on a 2-stroke crankcase compression principle and further including charge forming means formed at the front of the engine and forwardly of the output shaft for delivering a charge to crankcase chambers of the engine.

6. A combined engine and jet propulsion unit and watercraft as set forth in claim 1, wherein the transmission means comprises a pair of intermeshing bevel gears.

7. A combined engiine and jet propulsion unit and watercraft as set forth in claim 6, wherein the bevel gears are disposed forwardly in the water inlet portion of the jet propulsion unit outer housing.

* * * * *